United States Patent [19]

Major

[11] Patent Number: 4,844,422

[45] Date of Patent: Jul. 4, 1989

[54] BARBED TAPE BARRIER

[75] Inventor: Robert W. Major, Seymour, Conn.

[73] Assignee: American Fence Company, Inc., Phoenix, Ariz.

[21] Appl. No.: 79,584

[22] Filed: Jul. 30, 1987

[51] Int. Cl.[4] ..... B21F 25/00

[52] U.S. Cl. ..... 256/8; 256/6

[58] Field of Search ..... 256/8, 6

[56] References Cited

U.S. PATENT DOCUMENTS

| | | | |
|---|---|---|---|
| 238,296 | 3/1881 | Kirchoffer | 256/8 |
| 255,763 | 4/1882 | Brock | 256/8 |
| 2,908,484 | 10/1959 | Uhl | 256/8 |
| 3,010,701 | 11/1961 | Klemm | 256/8 |
| 3,224,736 | 12/1965 | Musgrave | 256/8 |
| 3,463,455 | 8/1969 | Meckel | 256/8 |
| 3,480,256 | 11/1969 | Simon et al. | 256/8 |
| 4,040,603 | 8/1977 | Mainiero | 256/8 |
| 4,509,726 | 4/1985 | Boggs et al. | 256/8 |

*Primary Examiner*—Andrew V. Kundrat

*Attorney, Agent, or Firm*—Cahill, Sutton & Thomas

[57] ABSTRACT

A barbed tape is disclosed incorporating an improved barb configuration. A flat metal tape is formed having opposed barbed pairs that extend from a central portion at an angle to thus point the tips of the respective barbs away from the longitudinal axis of the tape. The central strip of the tape is clenched about a central core wire; intermediate barbs are provided to increase the effectiveness of the barrier while providing a means for positively positioning clips that are used to secure adjacent coils of the tape together.

7 Claims, 2 Drawing Sheets

BARBED TAPE BARRIER

FIELD OF THE INVENTION

The present invention relates to security barriers of the type employing metal barbs formed of flat sheet metal, and more particularly security barriers presently known in the industry as barbed tape.

BACKGROUND OF THE INVENTION

The utilization of barbed tape has become prevalent in both military as well as commercial applications. The original barbed tape is exemplified by the structure disclosed in U.S. Pat. No. 2,908,484 issued Oct. 13, 1959 to Uhl. Such early barbed tape was typically referred to as "German barbed tape" and incorporated barbs formed from flat sheet metal stock. The efficacy of such barbed tape has been enhanced through subsequent developments such as shown in U.S. Pat. No. 3,463,455 issued Aug. 26, 1969 to P. T. Meckel.

Such improved barbed tapes incorporate a unitary flat metal strip that is bent in the plane of the strip to form a helix and includes cut-away portions to provide elongated barbs at spaced intervals along the two edges of the strip. These barriers may be formed with a continuous uniform arcuate curvature or, in some instances, may be formed by edge bending the strip into identically angularly displaced adjoining linear segments to form the helix; the segmented helix is disclosed for example in U.S. Pat. No. 4,040,603 issued Aug. 9, 1977 to Mainiero. A further improvement in such barbed tape is described and claimed and U.S. Pat. No. 4,509,726 issued Apr. 9, 1985 to Boggs et al. In the latter patent, it was recognized that the efficacy of the barbed tape design depends in large measure upon the penetrating or impaling ability of the respective barbs; that is, the barbs must have a sharp point and preferably should have sufficient length to permit the barb to contact and penetrate an intruder's skin or clothing. Further, it was realized that an important feature of the efficiency with which the barbed tape accomplished this purpose (i.e., to avoid or prevent intrusion into a protected area) depends to some measure on the intimidating appearance of the barrier formed by the deployed barbed tape. The intimidating effects of the barbed tape are particularly important in commercial applications where breaching the barrier presented by the barbed tape is a matter of choice for the intruder rather than a matter of necessity as may be the case in a military application. It is therefore important to retain all of the benefits afforded by the prior art barbed tape designs including the penetration/impalement capacity of the barb, and the value of the intimidating appearance of the barbed tape.

OBJECTS OF THE INVENTION

It is therefore an object of the present invention to provide a barbed tape configuration that will provide an effective and rugged barrier without increasing the cost of the tape.

It is another object of the present invention to provide a barbed tape barrier having increased effectiveness.

It is still another object of the present invention to provide a barbed tape structure having increased penetration/impalement characteristics while reducing the cost of the installed barbed tape.

It is still another object of the present invention to provide a less expensive barbed tape that can be efficiently produced while increasing the efficacy of the barbed tape to discourage intrusion.

These and other objects of the present invention will become apparent to those skilled in the art as the description thereof proceeds.

SUMMARY OF THE INVENTION

The present invention maintains the advantages achieved by the prior art barbed tape designs and provides increased efficiency and distinct additional advantages not heretofore obtainable. The present invention incorporates a barbed tape design that retains the benefits of an elongated barb; that is, effective impalement-/penetration capability and an intimidating appearance. Both of these benefits have been enhanced through the utilization of inclined barbs that position the respective barbs to facilitate snagging of an intruder's clothing or actual penetration of the intruder's skin. Further, the inclination of the barbs presents a substantially improved intimidating appearance since the points of the barb extend outwardly toward the prospective intruder to present a "porcupine effect", the points of the barbs are directed outwardly from the general cylindrical space occupied by the deployed barbed tape.

In addition to the increased effectiveness of the barbed tape through the improved impalement/penetration capability, and intimidating appearance, the barbed tape of the present invention permits significant savings in the shipping and installation of a given length of barbed tape. The particular improved barb configuration provides a means for achieving a weight reduction in the finished product; the weight reduction permits the manufacturer to lengthen the amount of barbed tape included within a roll of barbed tape of a given weight. When the barbed tape is installed, the labor involved in the installation is increased as a function of the number of rolls necessary to complete the job. Therefore, since the length of barbed tape in each roll of barbed tape constructed in accordance with the teachings of the present invention is longer, fewer rolls are required to accomplish a given installation. As a result, installation costs are reduced.

When the rolls of barbed tape are deployed or installed, adjacent coils in each roll are secured to each other at selected points. The method of attachment may be a clip or clamp ring; however, it is important that the clip remain in position to prevent longitudinal movement of one coil relative to an adjacent coil. The barbed tape of the present invention provides a positive positioning means to insure that such clips remain in position.

BRIEF DESCRIPTION OF THE DRAWINGS

The present invention may more readily be described by reference to the accompanying drawings in which.

DETAILED DESCRIPTION OF THE PREFERRED EMBODIMENT

Figure 1:
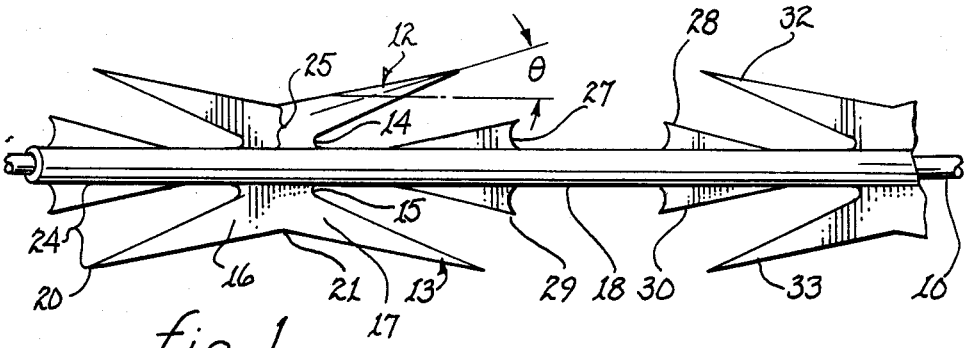
FIG. 1 is an elevational view of a section of barbed tape constructed in accordance with the teachings of the present invention.
Figure 2:
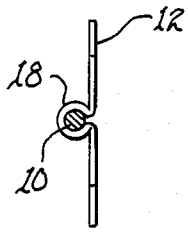
FIG. 2 is a side view of the barbed tape of FIG. 1.

Referring to FIGS. 1 and 2, the barbed tape in the embodiment chosen for illustration comprises a core wire 10 that may be formed from galvanized non-spring quality steel material. In some applications, the core wire may not be necessary. A flat sheet of metal such as stainless steel in the form of a flat strip of tape, the formation of which is to be described more fully hereinafter, is provided with opposing pairs of barbs 12 and 13 formed integrally therewith and extending in opposite directions; the roots 14 and 15 of the barbs connect the barbs to a central longitudinally extending strip 18 which is clinched about the core wire 10. The individual barbs in each of the pairs of barbs 12 and 13 also extend in opposite directions.

The resulting structure is a barbed tape having a reinforcing core wire 10 clamped or clinched by surrounding strip 18 to thus provide a semi-rigid tape structure with desireable springiness characteristics. The strip 18 is wrapped about the core wire 10; the barbs extend away from the central core wire 10 and strip 18 at an angle from approximately ten to forty-five degrees and preferably approximately twenty-three degrees shown in FIG. 1 as the angle $\theta$. The bases of the individual barbs, such the barbs 16 and 17, intersect to form a "V" configuration. It is important to note that the tips of the barbs such as the tip 20 extends further away from the core wire 10 or the strip 18 than the outside 21 of the base of the barb; that is, the distance 24 shown in FIG. 1 is always greater than the distance 25. This difference in those distances insures that the barbed tape tip such as that shown at 20 is angled outwardly away from the tape thus rendering the barb more likely to ensnare, snag or penetrate if it contacts an intruder or his clothing.

The outward extension of the tips of the barbs also enhances the intimidating character of a barrier formed of the barbed tape of the present invention. That is, the barbed tape is normally formed into coils that, when stretched out in the field and are thus deployed, present a generally helical coil with adjacent coils clipped to preceding and succeeding coils at predetermined spaces about the periphery. The overall result of such deployment of the barbed tape is the positioning of barbs around an imaginary cylinder. When the barbs on the tape are formed as described above, the outward inclination of the respective barbs and barbed points present an almost "porcupine" impression to a prospective intruder. The outward inclination of the barbs is in contrast to the prior are elongated barbs that generally "point" in a direction tangential to the imaginary cylinder to or parallel to a central core wire or strip of tape.

The barbed tape of the present invention is also provided with multiple intermediate barbs positioned along the tape axially displaced from adjacent pairs of barbs. Referring to FIG. 1, intermediate barb pair 27 and 28 and intermediate barb pair 29 and 30 are positioned along the strip 18 axially displaced from the major barbs 12 and 13 and a succeeding major barb pair such as shown at 32 and 33. The intermediate barb pairs 27–28 and 29–30 provide additional intimidating appearance as well as providing further ensnarement capabilities to the barb tape. Further, such intermediate barbs discourage attempts to grasp the barbed tape between the major barbs.

Figure 5:
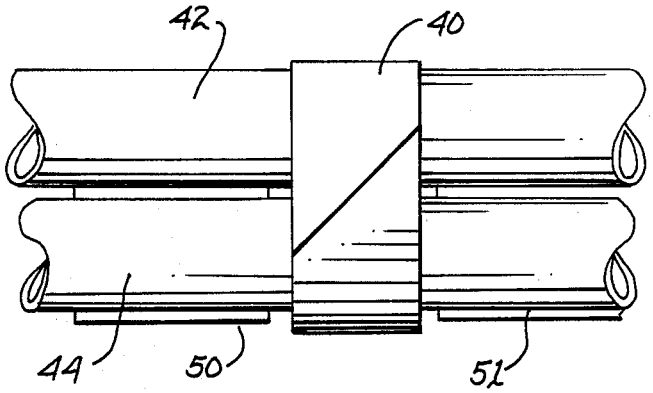
FIG. 5 is a top view of a portion of adjacent coils showing a securing clip in place.
Figure 6:
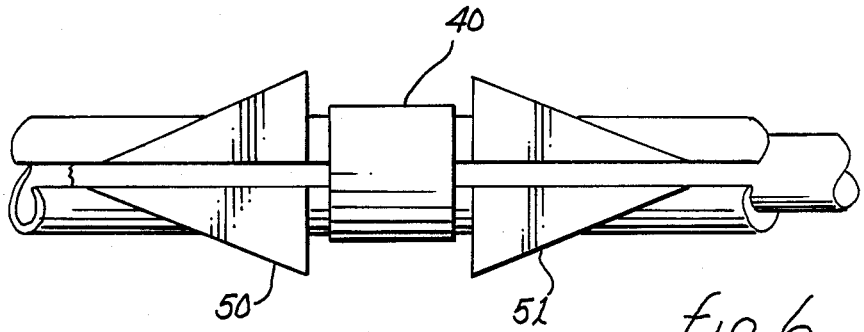
FIG. 6 is a front elevational view of the clip shown in FIG. 5.
Figure 7:
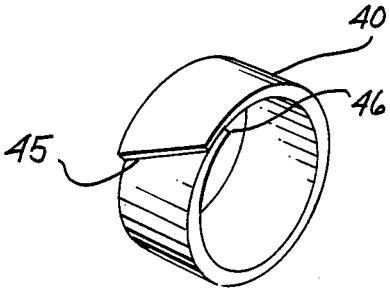
FIG. 7 is a perspective view of the clip shown in FIG. 5.

The barbed tape of the present invention is formed of a continuous strip of metal tape that is edge wound into a generally helical continuous tape with each successive loop of the helix attached to preceding and to succeeding loops at predetermined locations about the loop. The barbed tape is stored with the faces of the tape of each loop in contact with adjacent loops as shown and described in the above-identified prior art. See for example the patent to Mainiero et al, U.S. Pat. No. 4,503,423, wherein the specific relationship of adjacent loops or turns of the coils are described. Barbed tape loops of the type described in the above-identified prior art are attached to adjacent loops at predetermined points about the periphery of the loop. Thus, when the barbed tape is deployed or placed in position, the loops or coil turns are stretched to generally form a helical structure defining a cylindrical volume with the barbs positioned about the surface of the imaginary cylinder. The method of attachment of each loop to adjacent loops may vary; however, a convenient manner of attachment is the utilization of a clamp or clip. Referring to FIGS. 5, 6 and 7, a clip 40 is shown that may comprise a flat strip of metal that is formed into a ring or cylinder and firmly clamped over adjacent coils 42 and 44 to thus hold the loops in intimate contact at the location of the clip 40. The specific configuration of the clip may vary and in FIGS. 5, 6 and 7 is shown as a flat strip of metal formed into a ring or deformable cylinder with overlapping ends 45 and 46. An important consideration in the utilization of clamps or clips for attaching adjacent loops of barbed tape is the requirement that the fastened loops not be permitted to slip at the point of attachment with respect to each other. That is, in FIG. 5 it is important that the loop 42 not be permitted to slip longitudinally with respect to the loop 44. If such slippage occurs, then adjacent loops can assume different diameters resulting in less effective barriers.

In the barbed tape configuration of the present invention, the multiple intermediate barbs, such as those shown at 50 and 51 in FIG. 6, are spaced longitudinally with respect to each other to provide room to admit the clip 40 and maintain the clip in position to prevent relative slippage between the clip and the barbed tape.

When using a reinforcing wire, the utilization of the barbed configuration described above also provides unexpected advantages in that the resulting barb configuration includes an overall weight reduction from a conventional barbed tape configuration. In most instances, the reduction can amount to approximately fifteen percent. This weight reduction enables a manufacturer to increase the barbed tape roll lengths for a given shipping weight. Further, since installation costs attending the installation of barbed tape increases as the number of rolls of barbed tape are installed, the previously mentioned increased roll lengths permit a given installation to be accomplished with fewer rolls (although the same barbed tape barrier length) and therefore at a reduced installation cost.

Figure 3:
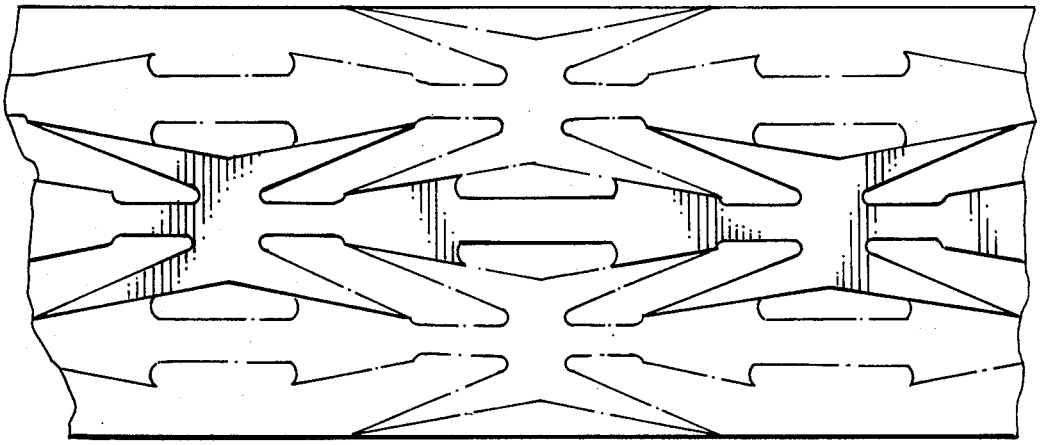
FIG. 3 is a plan view of a metal strip useful in describing the barbed tape of the present invention.

Referring to FIG. 3, the manner in which the barbed tape of the present invention is formed may be seen. Referring to FIG. 3, flat tape stock is shown that may comprise steel with appropriate characteristics, such as a selected stainless steel, and which normally is fed into a conventional punch machine for cutting. The tape stock will normally be in rolled form before being fed into the punching machine. The tape shown in FIG. 3 is sufficiently wide to permit the simultaneous formation of three strips of barbed tape. To facilitate the description, the center barbed tape being formed is shown in heavy outline. It may be seen that the tape is formed with a central strip having opposing pairs of barbs positioned along its length. To avoid wasting flat tape stock, the adjacent barb tapes are formed having their respective barbs interleaved with the barbs of the adjacent tape. Waste blanks are discarded and the resulting partially formed barbed tapes are separated and are subsequently joined with their corresponding central core wires to ultimately form the barbed tape shown in FIGS. 1 and 2.

Figure 4:
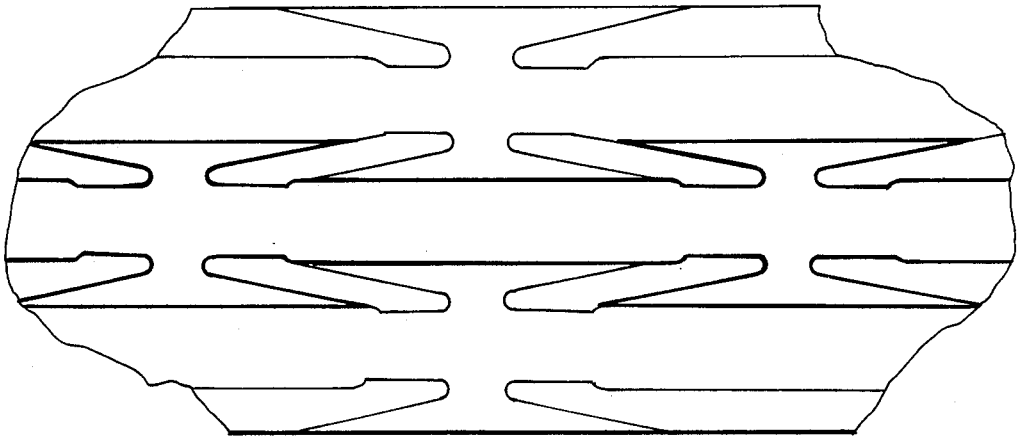
fig. 4 PRIOR ART
FIG. 4 is a plan view of a metal strip showing the forming of a prior art barbed tape and useful for comparison with the barbed tape of the present invention.

To recognize the advantages of the improved barb configuration, reference will now be had to FIG. 4 which indicates a similar technique for forming barbed tape of the prior art. It may be noted that the central strips of the barbed tape of FIG. 4 are substantially wider than the corresponding central strips of FIG. 3. The wider central strips are formed to permit a stiffening flange as shown and described in U.S. Pat. No. 4,509,726. Thus, a comparison of FIGS. 3 and 4 will show that although the flat tape stock is substantially the same width, the resulting barbed tape configuration of the present invention will result in an approximate fifteen percent weight savings.

As stated previously, in many applications the additional rigidity provided by the flange shown in the above-mentioned prior art is not necessary and the greater springiness provided by the barbed tape of the present invention may be advantageous. The enhanced barb configuration combined with the weight savings afforded by the tape configuration of the present invention presents a barbed tape having increased effectiveness both from the point of view of penetration/impalement and intimidation while nevertheless decreasing the cost of the installed barbed tape.

The enhanced barb configuration also renders the tape effective in many applications without the use of a reinforcing wire; the tape without the reinforcing wire may be used in an uncoiled configuration as a replacement for conventional barbed wire. That is, a single uncoiled strand of the tape may replace a corresponding strand of barbed wire.

I claim:

1. A barbed tape barrier comprising:

(a) a flat metal tape strip, edge wound to form a generally helical continuous metal tape with each successive loop of the helix attached to preceding and to succeeding loops at predetermined locations about the loop;

(b) a plurality of pairs of barbs positioned along said tape and formed integrally therewith, the individual barbs in each pair extending in opposite directions;

(c) each of said barbs having a tip and a base, the tip extending further from said tape than the outside of the base of the barb to thus position the individual barb at an angle extending outwardly from said tape with each of said barbs and barb tips inclined outwardly.

2. The combination as set forth in claim 1 wherein the bases of each pair of barbs intersect to form a "V" configuration.

3. A barbed tape barrier comprising:

(a) a flat metal tape strip, edge wound to form a generally helical continuous metal tape with each successive loop of the helix attached to preceding and to succeeding loops at predetermined locations about the loop;

(b) a plurality of pairs of barbs positioned along said tape and formed integrally therewith, the individual barbs in each pair extending in opposite directions;

(c) each of said barbs having a tip and a base, the tip extending further from said tape than said base to thus position the individual barb at an angle extending outwardly from said tape with each of said barbs and barb tips inclined outwardly;

(d) a plurality of pairs of intermediate barbs formed integrally with said tape, the individual barbs in each pair displaced longitudinally along said tape with respect to each other; and (e) attachment means positioned between the barbs of said pair of intermediate barbs on adjacent loops of said metal tape for securing said adjacent loops to each other, the intermediate barbs on said adjacent loops positioning said attachment means to prevent relative movement between said adjacent loops.

4. The combination as set forth in claim 3 wherein said attachment means is a cylindrical deformable clamp.

5. In a barbed tape barrier having an elongated edge wound helical strip of metal tape including barb extending therefrom, the improved barb configuration comprising:

(a) a plurality of pairs of barbs positioned along said tape and formed integrally therewith, the individual barbs in each pair extending in opposite directions;

(b) each of said barbs having a tip and a base, the tip extending further from said tape than the outside of the base of the barb to thus position the individual barb at an angle extending outwardly from said tape with each of said barbs and barb tips inclined outwardly.

6. The combination as set forth in claim 5 wherein the bases of each pair intersect to form a "V" configuration.

7. The combination as set forth in claims 1, 2 or 3 wherein said flat metal tape strip is clenched about a central core wire.

* * * * *